US006745726B2

(12) United States Patent
Joyce et al.

(10) Patent No.: US 6,745,726 B2
(45) Date of Patent: Jun. 8, 2004

(54) ENGINE THERMAL MANAGEMENT FOR INTERNAL COMBUSTION ENGINE

(75) Inventors: Steven Joyce, Redhill (GB); Chris Whelan, Southwick (GB); Iain Gouldson, Billericay (GB); Chris Bush, West Chiltington (GB); Noel Henderson, Chipping Ongar (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/207,673

(22) Filed: Jul. 29, 2002

(65) Prior Publication Data

US 2004/0016411 A1 Jan. 29, 2004

(51) Int. Cl.[7] ..... F01P 7/14
(52) U.S. Cl. ..... 123/41.1; 123/41.54
(58) Field of Search ..... 123/41.1, 41.54

(56) References Cited

U.S. PATENT DOCUMENTS

| | | | | |
|---|---|---|---|---|
| 2,285,248 A | * | 6/1942 | Aske | 123/41.08 |
| 4,337,733 A | | 7/1982 | Hirata et al. | |
| 4,549,505 A | | 10/1985 | Hirano et al. | |
| 4,624,221 A | | 11/1986 | Fujigaya et al. | |
| 4,658,766 A | | 4/1987 | Hirano | |
| 4,785,874 A | | 11/1988 | Avrea | |
| 5,113,807 A | | 5/1992 | Kobayashi | |
| 5,390,632 A | * | 2/1995 | Ikebe et al. | 123/41.1 |
| 5,561,243 A | | 10/1996 | Machida | |
| 5,619,957 A | | 4/1997 | Michels | |
| 5,836,269 A | | 11/1998 | Schneider | |
| 5,868,105 A | | 2/1999 | Evans | |
| 6,032,618 A | | 3/2000 | Ferrari et al. | |
| 6,109,219 A | | 8/2000 | Sano | |
| 6,135,067 A | | 10/2000 | Klamm et al. | |
| 6,223,700 B1 | | 5/2001 | Sano et al. | |
| 6,340,006 B1 | | 1/2002 | Malatto et al. | |
| 6,374,780 B1 | | 4/2002 | Rutyna et al. | |
| 6,539,899 B1 | * | 4/2003 | Piccirilli et al. | 123/41.1 |
| 2001/0020452 A1 | | 9/2001 | Suzuki et al. | |

FOREIGN PATENT DOCUMENTS

| | | |
|---|---|---|
| FR | 2 455 174 | 11/1980 |
| FR | 2456838 | 12/1980 |
| GB | 2159878 | 12/1985 |
| GB | 2348485 | 10/2000 |

OTHER PUBLICATIONS

James E. Duffy, *Modern Automotive Technology*, 2000, pp. 706–707.

* cited by examiner

*Primary Examiner*—Noah P. Kamen
(74) *Attorney, Agent, or Firm*—MacMillan, Sobanski & Todd LLC

(57) ABSTRACT

An engine thermal management system and method for a vehicle engine that allows for reduced coolant flow and energy consumption by the system, while avoiding excessive critical metal temperatures in the engine. The engine includes a coolant inlet in a head and a coolant outlet in a block. A variable speed pump pushes the coolant into the head inlet. A multi-port valve receives the coolant exiting the engine block and selectively routes it to various system components. The speed of the pump and the valve are electronically controlled by a control module, based upon various engine and vehicle operating conditions.

7 Claims, 1 Drawing Sheet

ENGINE THERMAL MANAGEMENT FOR INTERNAL COMBUSTION ENGINE

BACKGROUND OF INVENTION

The present invention relates to engine thermal management, and more particularly to engine thermal management where temperatures are precisely controlled and flow rates of the coolant are reduced.

Conventionally, in a vehicle engine, a cooling circuit employing a radiator is used to remove excess heat from the engine, maintain a constant operating temperature, increase the temperature in a cold engine quickly, and heat the passenger compartment. The cooling circuit uses a coolant, which is typically a mixture of water and anti-freeze. The cooling circuit includes a water pump that is powered via the crankshaft of the engine, and forces the water through the cooling circuit components. The flow path typically consists of the coolant flowing from the water pump through the engine block passages, then through the engine head passages, then out of the engine and through hoses to the radiator, and from the radiator through a hose back to the water pump. A portion of the coolant may also be routed through a heater core when there is heat demand in the passenger compartment of the vehicle, or through a radiator bypass when the coolant temperature is below its desired operating temperature. The volume of coolant flow is kept high enough to assure that all of the engine components are cooled sufficiently under extreme operating conditions. With this high volume of coolant flow, the coolant temperature to the engine is generally low, with a generally constant coolant temperature for coolant leaving the engine. This high volume makes assuring that all of the engine components remain below their critical metal temperatures relatively easy. However, these conventional engine cooling systems, while straight forward and relatively easy to implement, are not very good at providing optimum cooling for the particular engine and vehicle operating conditions—particularly since the water pump speed is strictly a function of the engine speed (not the amount of cooling needed by the system), and the routing of the coolant to the various components of the system is limited. Moreover, the system tends to consume more power to operate than is desirable.

In order to obtain more precise cooling for engine, advanced engine thermal management systems have been developed. A more advanced system may be, for example, a system and method as described in U.S. Pat. No. 6,374,780, assigned to the assignee of this application, and incorporated herein by reference. These newer systems take into account addition factors that influence both what the desired coolant temperature is and how it is achieved. Such a system might include a water pump (with variable speed control) that pumps water into the engine block passages, then through the engine head passages and out into a flow control valve. The flow control valve then selectively distributes the flow between the radiator, a bypass line, the heater core, and a degas container. With the improved efficiency of heat transfer and more precise control over the engine cooling, these advanced systems can operate with a reduced flow rate of coolant. This allows for minimizing the pumping power used and also maintains higher metal temperatures during the majority of the driving cycle of the vehicle (mainly at low engine power conditions), which allows for improved engine operation. However, under high engine power conditions, the lower heat transfer coefficients due to the reduced coolant flow increase the potential for excessive metal temperatures at certain locations in the engine. In particular, as the coolant flow rate is reduced, the coolant temperature rise across the engine (from where the coolant enters the engine to where it exits) increases. And, since a dominant parameter in controlling the metal temperature is the local coolant temperature, excessive metal temperatures at certain locations can occur.

In particular, these advanced systems also direct the flow of coolant in the same direction through the engine as the conventional engine cooling systems—that is, the water pump sends the coolant into the engine block, and then from the block the coolant flows to the head, and then is returned to the radiator for cooling. The reduced coolant flow does not adversely effect the vehicle radiator heat dissipation since it is controlled more by the air flowing through the radiator than by the coolant flow rates. However, due to the significant temperature rise of the coolant across the engine, this can create a situation where the critical metal temperature for certain portions of the engine head are exceeded.

Thus, it is desirable to minimize the coolant flow rates, and accordingly cooling power requirements, in an advanced engine thermal management system, while avoiding excessive critical metal temperatures in the engine.

SUMMARY OF INVENTION

In its embodiments, the present invention contemplates an engine thermal management system for an engine having head, with a coolant inlet and head passages connected to the inlet, and a block, with a coolant outlet and block passages connected between the head passages and the outlet. The engine thermal management system has a water pump having a pump outlet adapted to operatively engage the coolant inlet and pump a coolant thereto, and a pump inlet; and a multi-port valve having a valve inlet adapted to operatively engage the coolant outlet of the block, a first valve outlet selectively engagable with the valve inlet, and a second valve outlet selectively engagable with the valve inlet. A radiator operatively engages the first valve outlet and the pump inlet, and a bypass operatively engages the second valve outlet and the pump inlet. The engine thermal management system also includes a controller operatively engaging the valve to control the selective engagement of the valve inlet with the first valve outlet and the second valve outlet.

The present invention further contemplates a method of controlling the cooling of an engine, having a block and a head, in a vehicle comprising the steps of: pumping coolant into a coolant inlet in the head of the engine; routing the coolant through coolant passages in the head; routing coolant from the coolant passages in the head to coolant passages in the block of the engine; routing the coolant from the coolant passages in the block to a coolant outlet in the block; routing the coolant from the coolant outlet in the block to an inlet of a multi-port valve; selectively routing portions of the coolant from the inlet of the valve to at least one of a radiator, a heater core, a bypass, and a degas container; and electronically controlling the pumping of the coolant and the routing through the multi-port valve based on engine operating conditions.

An advantage of the present invention is that coolant flow rates in the engine cooling circuit are reduced while still being able to maintain the desired engine operating temperature. This allows for a reduction in the power consumed by the cooling.

A further advantage of the present invention is that, while the coolant flow rates are reduced, the critical metal temperatures in the engine head are maintained at acceptable levels.

DETAILED DESCRIPTION

Figure 1:
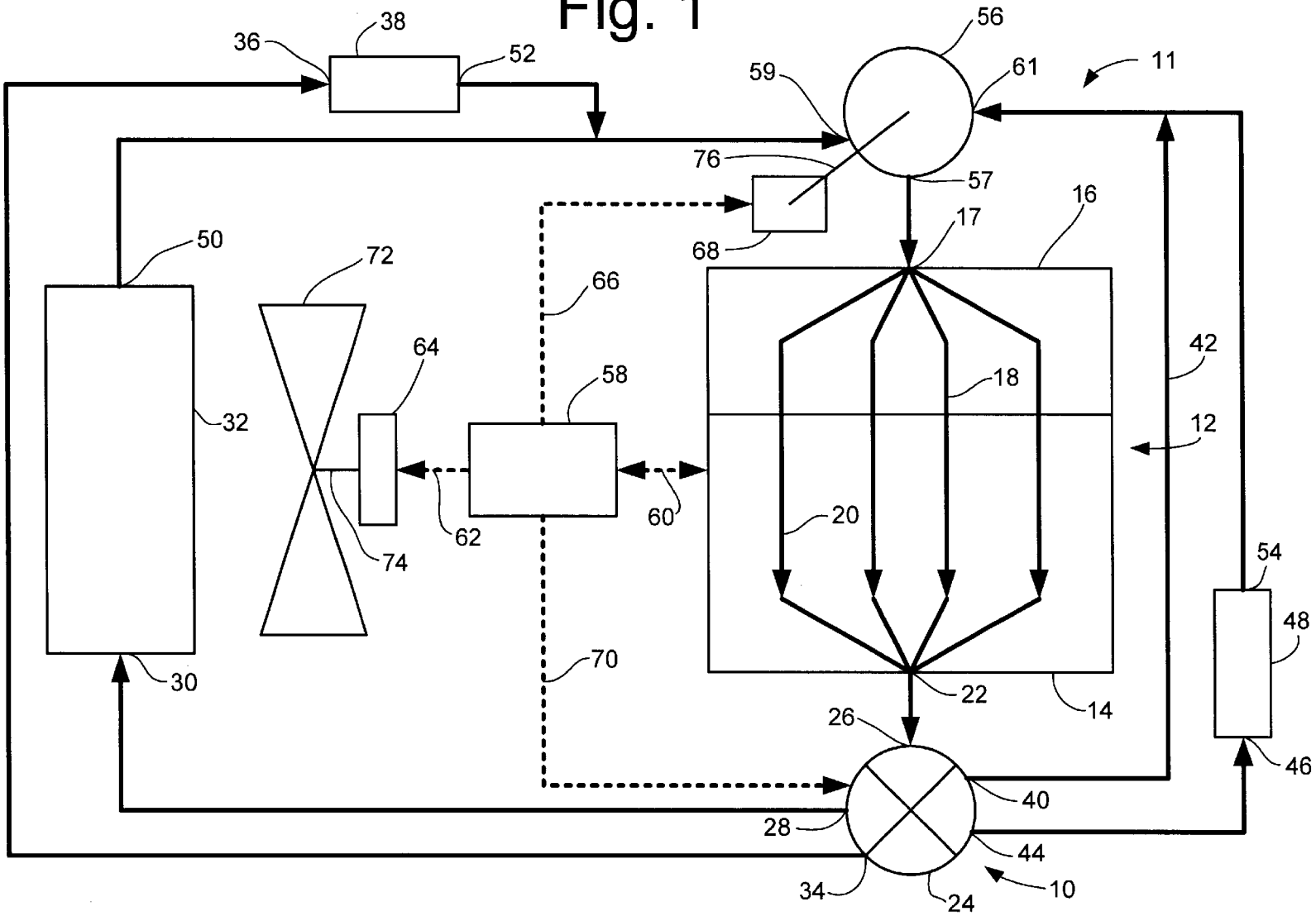
FIG. 1 is a schematic diagram of an engine coolant circuit and engine in accordance with the present invention.

FIG. 1 illustrates an engine cooling circuit 10 and engine 12, for an engine thermal management system 11. The engine 12 includes a block 14 and a head 16, with an inlet 17 to coolant passages 18 in the head 16 and coolant passages 20 in the block 14 leading to an outlet 22. The coolant flow paths in FIG. 1 are shown as heavy lines, with arrowheads indicating the direction of coolant flow. An electronically controllable, multi-port valve assembly 24 receives the coolant from the block outlet 22 at a valve inlet port 26. A first valve outlet 28 directs coolant to an inlet 30 on a radiator 32, a second valve outlet 34 directs coolant to an inlet 36 on a degas container 38, a third valve outlet 40 directs coolant to a bypass line 42, and a fourth valve outlet 44 directs coolant to an inlet 46 on a heater core 48. A radiator outlet 50, a degas outlet 52, a heater core outlet 54, and the bypass line 42 all direct the coolant back to one or two inlets 59, 61 on a water pump 56. The water pump 56 then pumps the coolant through an outlet 57 to the head inlet 17 of the engine 12.

A control module 58 is electrically connected to the engine 12 and cooling circuit 10 in order to monitor and control the engine thermal management process. The control module 58 communicates with various subsystems and sensors on the engine 12 through various electrical connections 60. Electrical connections are illustrated in FIG. 1 by dashed lines. The control module 58 also has an electrical connection 62 to a fan motor 64, an electrical connection 66 to a pump motor 68 and an electrical connection 70 to the valve 24. An engine fan 72 is driven, via an input shaft 74, by the fan motor 64, and the pump 56 is driven, via an input shaft 76, by the pump motor 68. While electric motors are shown controlling the pump 56 and the fan 72, other variable speed mechanisms that allow for variable control of the fan and water pump may be employed instead, if so desired.

The operation of the system will now be described. After the start-up of a cold engine, the control module 58 will drive the water pump 56 at a minimal speed (enough to avoid hot spots in the engine above critical metal temperatures), the valve 24 will route most of the coolant through the bypass 42 rather than the radiator 32 (in order to speed warm-up of the engine), and the valve 24 will route some coolant through the heater core 48 (if there is heat demand for the passenger compartment of the vehicle). The position of the flow control valve 24, and hence the routing of the coolant, is controlled by signals from the control module 58. If there is high engine load, high engine speed operating condition that occurs during this warm-up, the critical metal temperature for some portions of the head 16 can be approached. But even with the low volume of coolant being pumped, the coolant will be at a low temperature as it enters the head inlet 17 and flows through the head coolant passages 18, thus preventing the critical metal temperatures from being exceeded.

After the engine 12 is warmed up to operating temperature, the control module 58 monitors and adjusts the engine temperature by using multiple inputs from the engine 12 and other sensors to constantly minimize the difference between the current engine temperature and the currently desired engine temperature. The factors for determining the currently desired engine temperature may be, for example, the engine load (throttle position), engine speed, ambient air temperature, passenger compartment heat demand, air conditioning head pressure, vehicle speed, and possibly other vehicle operating conditions. The particular engine temperature being targeted may be coolant temperature or head temperature, as is desired for the particular engine cooling system. Also, preferably, the control module 58 operates with a hierarchy to minimize the overall energy consumption of the cooling system while achieving and maintaining the currently desired engine temperature. For example, if the engine temperature is too high, the control module 58 first adjusts the flow control valve 24 to provided more flow to the radiator 32 and less to the bypass 42. Then, if needed, it will increase the speed of the water pump 68 by increasing the speed of the pump motor 68. And finally, if still more cooling is needed, the control module 58 will increase the speed of the fan 72 by increasing the speed of the fan motor 64.

Since the engine temperature can be more precisely controlled with the engine thermal management system 11, it can operate at higher engine temperatures when needed for improved engine performance or reduced vehicle emissions without exceeding allowable engine temperature conditions. This higher temperature operation further reduces the need for a high volume of coolant flow through the thermal management system 11.

One will note that, with these control strategies, for both engine warm-up and normal operating conditions, the coolant flow is generally minimized, which will reduce the power consumed by the thermal management system 11, as well as improve overall engine operation. However, with the reduced coolant flow through the engine 12, this increases the likelihood of hot spots that exceed the critical metal temperatures. With the reverse flow cooling, then, as the coolant flow is reduced, the inlet temperature tends to fall, which will tend to reduce the metal temperature in the head 16, counteracting the fact that the heat transfer coefficient is reduced due to the low coolant flow rate. The net result is that, where the reduced coolant flow is combined with the reversed flow of coolant through the engine 12, the critical metal temperatures in the head 16 do not increase to the same extent as with a conventional coolant flow direction through the engine.

While certain embodiments of the present invention have been described in detail, those familiar with the art to which this invention relates will recognize various alternative designs and embodiments for practicing the invention as defined by the following claims.

What is claimed is:

1. A vehicle apparatus comprising:

an engine having head, with a coolant inlet and head passages connected to the inlet, and a block, with a coolant outlet and block passages connected between the head passages and the outlet;

a water pump having a pump outlet operatively engaging the coolant inlet and pump a coolant thereto, and a pump inlet;

a multi-port valve having a valve inlet operatively engaging the coolant outlet of the block, a first valve outlet selectively engagable with the valve inlet, a second valve outlet selectively engagable with the valve inlet, a third valve outlet selectively engagable with the valve inlet, and a fourth valve outlet selectively engagable with the valve inlet;

a radiator operatively engaging the first valve outlet and the pump inlet;

a bypass operatively engaging the second valve outlet and the pump inlet;

a heater core operatively engaging the third valve outlet and the pump inlet;

a degas container operatively engaging the fourth valve outlet and the pump inlet; and a controller operatively engaging the valve to control the selective engagement of the valve inlet with the first valve outlet, the second valve outlet, the third valve outlet and the fourth valve outlet;

2. A The apparatus of claim 1 further including a pump motor operatively engaging the pump to drive the pump thereby, and with the pump motor electronically controlled by the controller.

3. The apparatus of claim 1 further including an engine fan located adjacent to the radiator, and a fan motor operatively engaging the fan to drive the fan thereby, and with the fan motor electronically controlled by the controller.

4. An engine thermal management system for an engine having head, with a coolant inlet and head passages connected to the Inlet, and a block, with a coolant outlet and block passages connected between the head passages and the outlet, the engine thermal management system comprising:

a water pump having a pump outlet adapted to operatively engage the coolant inlet and pump a coolant thereto, and a pump inlet;

a multi-port valve having a valve inlet adapted to operatively engage the coolant outlet of the block, a first valve outlet selectively engagable with the valve inlet, a second valve outlet selectively engagable with the valve inlet, and a third valve outlet selectively engagable with the valve inlet;

a radiator operatively engaging the first valve outlet and the pump inlet;

a bypass operatively engaging the second valve outlet and the pump inlet;

a degas container operatively engaging the third valve outlet and the pump inlet; and a controller operatively engaging the valve to control the selective engagement of the valve Inlet with the first valve outlet and the second valve outlet.

5. The engine thermal management system of claim 4 further including a heater core operatively engaging the pump inlet; and wherein the multi-port valve further includes a fourth valve outlet selectively engagable with the valve inlet and operatively engaging the heater core.

6. The engine thermal management system of claim 4 further including a pump motor operatively engaging the pump to drive the pump thereby, and with the pump motor electronically controlled by the controller.

7. The engine thermal management system of claim 4 further including an engine fan located adjacent to the radiator, and a fan motor operatively engaging the fan to drive the fan thereby, and with the fan motor electronically controlled by the controller.

* * * * *